United States Patent [19]

Eguchi

[11] Patent Number: 4,963,046

[45] Date of Patent: Oct. 16, 1990

[54] TOOTHBRUSH

[75] Inventor: Yasuteru Eguchi, Funabashi, Japan

[73] Assignee: Kao Corporation, Tokyo, Japan

[21] Appl. No.: 187,262

[22] Filed: Apr. 28, 1988

[30] Foreign Application Priority Data

May 13, 1987 [JP] Japan ..... 62-71078
May 27, 1987 [JP] Japan ..... 62-80670

[51] Int. Cl.[5] ..... B43K 5/04
[52] U.S. Cl. ..... 401/160; 401/284
[58] Field of Search ..... 401/175, 132, 268, 270, 401/269, 160, 164, 183, 184, 186, 286, 279, 143; 15/167.1, 159 A

[56] References Cited

U.S. PATENT DOCUMENTS

| | | | |
|---|---|---|---|
| 754,000 | 3/1904 | Munro | 401/143 X |
| 1,062,480 | 5/1913 | Larocque | 401/268 |
| 1,678,601 | 7/1928 | Cavanaugh | 401/280 X |
| 3,217,720 | 11/1965 | Cyzer | 222/153 X |
| 3,378,870 | 4/1968 | Matsunaga | 401/268 |
| 3,432,245 | 3/1969 | Hudson | 401/184 X |
| 3,618,154 | 11/1971 | Muhler et al. | 401/268 |
| 3,691,585 | 9/1972 | Flom | 15/167.1 X |
| 3,903,888 | 9/1975 | Buelow et al. | 401/270 X |
| 4,071,300 | 1/1978 | Nichols et al. | 401/175 |
| 4,269,207 | 5/1981 | Konrad et al. | 401/175 X |
| 4,429,434 | 2/1984 | Sung-shan | 401/286 X |
| 4,724,569 | 2/1988 | Eguchi et al. | 15/167.1 |

FOREIGN PATENT DOCUMENTS

| | | | |
|---|---|---|---|
| 197802 | 2/1978 | France | 401/279 |
| 51-19964 | 2/1976 | Japan . | |
| 51-35263 | 3/1976 | Japan . | |
| 52-364 | 1/1977 | Japan . | |
| 52-47974 | 4/1977 | Japan . | |
| 53-30973 | 3/1978 | Japan . | |
| 55-90338 | 6/1980 | Japan . | |
| 55-102835 | 7/1980 | Japan . | |
| 55-107129 | 7/1980 | Japan . | |
| 55-107130 | 7/1980 | Japan . | |
| 57-57839 | 4/1982 | Japan . | |
| 57-68367 | 4/1982 | Japan . | |
| 60-128532 | 8/1985 | Japan . | |
| 2035076 | 6/1980 | United Kingdom | 15/167.1 |

*Primary Examiner*—Richard J. Apley
*Assistant Examiner*—D. F. Crosby
*Attorney, Agent, or Firm*—Flynn, Thiel, Boutell & Tanis

[57] ABSTRACT

A toothbrush comprises a grip portion and a brush base portion having bristles implanted thereon. The bristles each have a spherical tip. The grip portion has a storage chamber for a fluid material. A communicating passage through which the fluid material may be fed extends from the storage chamber to the bristle-implanted portion so that the fluid material can be fed through the communicating passage. A polishing material may be contained in the tips of the bristles. A medicinal material for oral health or a gingiva-massaging medicine may be contained in the storage chamber.

6 Claims, 2 Drawing Sheets

TOOTHBRUSH

This invention relates to a toothbrush and in particular to a toothbrush which is useful to clean teeth and massage the gingiva. Moreover it may apply a polishing material, a fluid material for oral use, a medicinal material for oral health and a gingiva-massaging medicine.

STATEMENT OF PRIOR ART

Conventional toothbrushes are intended to remove deposits adhering on the surfaces of teeth, i.e., plaque on the teeth, to prevent dental decay.

From the viewpoint of oral hygiene, it is important to prevent gum-related diseases, such as gum inflammation in addition to preventing decay. For the prevention of gum-related diseases, massaging of gums is said to be effective. And there have been proposed some gum-massaging toothbrushes, most of which have a number of bristles made of resilient materials implanted in the toothbrush (Examples include Japanese Utility Model Laid-Open Nos. 102835/1980, 107129/1980, 107130/1980 and 57839/1982).

Also proposed are a number of toothbrushes in which toothpaste is stored in a storage portion provided in the toothbrush grip so that the toothpaste is supplied to the brush base (Examples include Japanese Utility Model Laid-Open Nos. 19964/1976, 35263/1976, 364/1977, 47974/1977, 30973/1978, 90338/1980, and 128532/1985).

In supplying the dentifrice to the brush portion, it is a common practice to provide a narrow communicating passage between the storage portion and the brush base. In this construction, after the brushing is finished, the dentifrice is left in the communicating passage, so that the water contained in the dentifrice dissipates thereby deteriorating the fluidity of the dentifrice, blocking the communicating passage, and making the toothbrush virtually impossible to use.

Deterioration of dentifrice fluidity is caused mainly by the polishing substance in the dentifrice. So, to prevent deterioration of fluidity, a possible method may be to charge a dentifrice containing no polishing substance into the storage portion. Because it contains no polishing substance, this dentifrice is not satisfactory in its deposit removing performance.

However, so far there have been proposed no gum massaging toothbrushes of a type in which bristles suitable for massaging the gums are implanted on the brush base and medicine aiding in the massaging of the gum is stored in the grip portion.

SUMMARY OF THE INVENTION

The invention provides a toothbrush with bristles having tips of a spherical form and a container for a fluid material for oral use, such as a medicinal material for oral health, a gingiva-massaging medicine and a polishing material.

A toothbrush of the invention comprises a brush base portion having bristles implanted thereon, said bristles having spherical tips or ends and a grip portion or handle provided with a storage means or container for a fluid material, a communicating passage through which the fluid material may be fed from the storage means to the bristle-implanted portion and a means for driving the fluid material through said communicating passage.

Fifty percent or more of the bristles have spherical tips. All the bristles preferably have spherical tips.

A polishing material may be contained in the tips of the bristles. A medicinal material for oral health or a gingiva-massaging medicine may be contained in the storage means.

Figure 3:
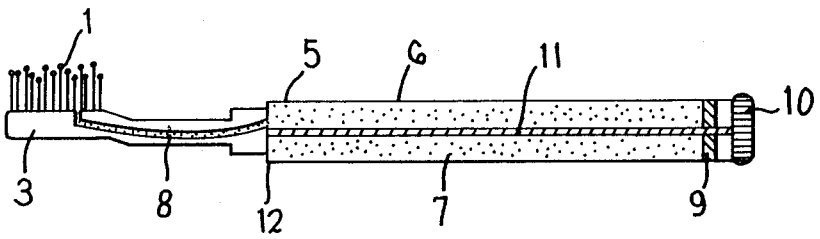
FIG. 3 is a schematic longitudinal cross section of the toothbrush of the Example 1.

In the drawings, the reference numbers identify parts as follow 1 . . . bristle, 2 . . . polishing material, 3 . . . brush base, 4 . . . bristle implanting hole, 5 . . . grip, 6 . . . storage portion, 7 . . . oral-use fluid material, 8 . . . communicating passage, 9 . . . push piece, 10 . . . thumb wheel, 11 . . . rotatable shaft, 12 . . . joint, 13 . . . narrow tube, 14 . . . rotatable disk, 15 . . . projection, 16 . . . leak valve.

The bristles for the toothbrush of the invention are formed at their tips in a global or spherical form. It is preferable that at least 80% of the bristles have the spherical tips. When tips contain the polishing agent, at least 50% of the bristles may have the spherical tips. It is more desirable that all the bristles have spherical tips. The material which the is made is not limited but may preferably be plastics, such as nylon and polybutylene terephthalate. The bristle diameter (diameter of the bristle body, not the tip diameter) is not limited, but experience has shown that the bristle diameter is preferably from 6/1000 to 15/1000 inches because of the feeling on the gums. The diameters of the spherical bristle tips are preferably 1.1 to 2.5 times the bristle body diameter.

The spherical tips of the bristles need not necessarily be perfect globe shapes and they may be oval, claw-like, or rectangular, square or trapezoidal with their four corners rounded, as long as they provide an improved massaging effect.

The pattern in which the bristles 1 are implanted on the base 3 is also not restricted. The bristles may be slightly different in height from one another or they may be set to almost equal heights. The density of the bristles is not limited and may appropriately be determined to obtain a good massaging effect.

The toothbrush of the invention has two typical embodiments which will be illustrated below.

One embodiment relates to a gingiva-massaging toothbrush which consists of a bristle base 3 and a grip 5; bristles implanted on the bristle 1 base 3 and having their ends formed in the shape of a globe, a storage portion 6 formed in the grip 5 for storing the medicine to be applied to the gums; a communicating passage 8 for supplying the medicine from the storage portion 6 to the bristle-implanted surface on the brush base 3 and a means for delivering the medicine into and moving it through the communicating passage 8.

Regarding the storage portion 6 in the grip portion 5 for the gum massaging medicine, the container for the gum medicine is not limited to a particular size and shape. It is, however, desirable that its size and shape be such that the user will not feel clumsy when holding the grip in her/his hand. The brush base 3, the grip 5 and the storage portion 6 for the gum medicine may either be formed integral as a unit in which they cannot be separated or formed in such a way that they can be separated. It is also possible to have the brush base 3 and the grip 5 formed integral and the storage portion 6 formed as a cartridge container which can be disconnected from the grip 5 for replacement. Further, the brush base may be formed separable from the body for replacement. In either case, it is desirable that the storage portion 6 form a part of the grip 5 when in use.

There is no restriction on the size and shape of the communicating passage 8 which is installed in the brush base and grip for supplying the medicine from the storage portion to the brush base.

Examples of the means for delivering the medicine into and through the communicating path 8 may include: one in which a push rod is used to extrude the medicine out of the storage container 6 formed of a flexible material; one in which the storage portion 6 and the communicating path 8 are connected by a flexible narrow tube and in which a rotatable disk placed in contact with the flexible narrow tube wall is rotated to deliver the medicine into the tube; one in which a hollow portion in the grip is used as a storage portion and in which a push piece, that is installed at the end of the grip opposite to the brush base and that is movable toward the brush base, is pushed toward the brush base to deliver the medicine from the storage portion into the communicating path; and one in which a diaphragm pump as the delivery means is incorporated in the communicating path, such as that introduced in the Japanese Patent Laid-Open No. 68367/1982. The medicine delivery means is not limited to these examples.

The other embodiment of the toothbrush comprises: a brush base 3 and a grip; 5 bristles 1 implanted on the brushbase, the bristles having their tips formed in globular shape, the globular portions of the bristles incorporating polishing material 2; a storage portion 6 provided in the grip for storing a fluid material for oral use; a communicating passage 8 for supplying the oral-use fluid material from the storage portion to the bristle implanting surface on the brush base; and a means for drawing the oral-use fluid material into and moving it through the communicating passage.

In this device the fluid material for oral use which is stored in the grip does not contain polishing material at all or, if any, only a very small amount thereof, whereby to prevent clogging of the communicating passage 8 connecting the storage portion 6 and the brush base 3. The fluid oral-use material that meets this requirement may include a general dentifrice free of polishing material and a medicine to be used on the gums to stimulate blood circulation in the gums and prevent tooth-related diseases. These materials can be appropriately adjusted in viscosity, from a watery fluid material with low viscosity to a paste or creamy substance with high viscosity.

As mentioned above, since the oral-use material for the toothbrush of this device has virtually no polishing effect, it is not satisfactory as a dentifrice. Thus, to give a polishing effect, the toothbrush of this device provides a polishing material on the globular the tips of the bristles. Moreover, the globular tips of the bristles will help remove the deposits on teeth and will not easily hurt the gums, making the toothbrush an adequate means for massaging the gums.

To make the polishing material adhere to the globular tips of the bristles, the polishing material is first attached to the tips of the monofilaments of synthetic resin, such as nylon or polybutylene terephthalate, and then the synthetic resin globes are heated to fuse the polishing material to the globes. The desired bristles are thus obtained.

The polishing material used in this device may include, for instance, silicic anhydride, calcium secondary phosphate, calcium carbonate, insoluble sodium metaphosphate, hydroxyapatite, zeolite, aluminum hydroxide, alumina, titanium oxide, various ceramic powders, and metal powder. The grain diameter of the polishing material is preferably in the range of 0.1 to 15 microns and more preferably in the range of 2 to 10 microns. The amount of polishing material contained in the bristles is preferably in the range of 0.1 to 50 weight-% and more preferably in the range of 5 to 30 percent by weight.

As to the storage means and the driving means to feed and deliver the fluid material to the bristle portion, those described for the first embodiment may apply here.

The gum massaging toothbrush according this invention has globes formed at the tips of the bristles, so that there is no fear of the bristles hurting the gums while brushing and instead they can provide an appropriate massaging effect on the gums. Also since the massaging medicine is incorporated in the toothbrush, the medicine can be supplied to the bristle-implanting surface on the base by a single operation. Because of these features, the toothbrush of this device is very effective as a gum massaging toothbrush.

The toothbrush according to this device has globes formed at the tips of the bristles, so that the toothbrush has an excellent tooth cleaning effect and also can massage the gums without hurting them. Also, since the polishing material is attached to the globes at the tips of the bristles and the fluid oral-use substance is contained in the grip portion, it is possible to supply the fluid material to the bristle-implanting surface on the brush base by a single operation. Another advantage is that the communicating passage will not be clogged by the polishing material.

EXAMPLE 1

Figure 1:
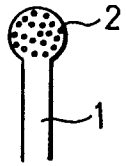
FIG. 1 is an enlarged view of one example of the bristle tip used on the toothbrush of this invention.

Monofilaments of nylon (8/1000 inches in diameter) are cut to a length of 30 mm and a dispersion liquid of silicic anhydride (silicic anhydride 5.0 wt% and sodium lauryl sulfate 0.1 wt%) is applied to the tips of the filaments. The monofilament tips, after being dried, are heated to fuse the silicic anhydride particles to the filament tips to form a bristle as indicated in FIG. 1. In FIG. 1, reference numeral 1 denotes a bristle and 2 denotes the polishing material.

Figure 2:
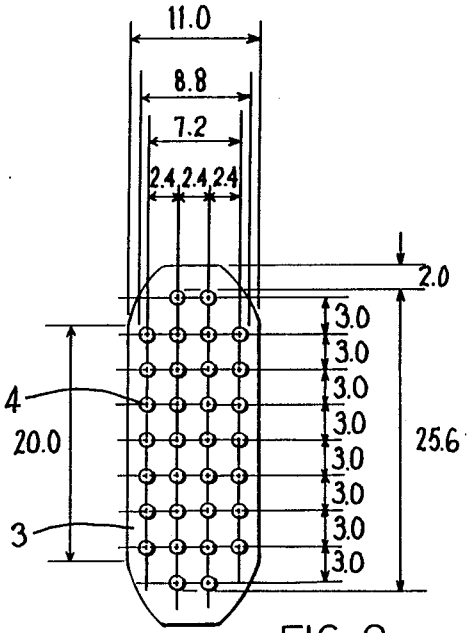
FIG. 2 illustrates the bristle implanting pattern.

As shown in FIG. 2, a brush base 3 has a pattern of bristle holes 4 and the bristles implanted on the base are about 11 mm high.

Referring to FIG. 3, the hollow portion in the grip 5 is used as a storage portion 6 for the fluid oral-use material, and dentifrice 7, which is a conventional one but is free of polishing material, is charged into the hollow storage portion 6. The grip 5 and the brush base 3 are separably coupled together through a threaded joint 12. Provided between the brush base 3 and the grip 5 is a communicating passage 8 for supplying the fluid oral-use material from the storage portion 6 to the bristle-implanted surface on the brush base 3. Provided at the end of the grip 5 opposite to the brush base 3 is a push piece 9 which is movable toward the brush base 3. As a thumb wheel 10 is rotated to turn a shaft 11, push piece 9 is moved toward the brush base 3 to deliver the fluid oral-use material (dentifrice free of polishing material) 7 into the communicating passage 8.

EXAMPLE 2

Figure 4:
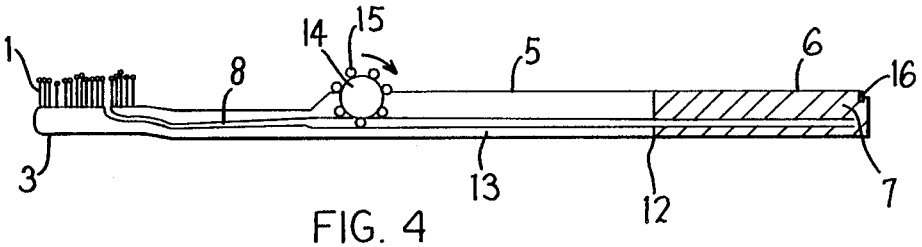
FIG. 4 is a schematic longitudinal cross section of the toothbrush of the Example 2.

A toothbrush of this Example is shown in FIG. 4. In this toothbrush the brush base 3 has a bristle implantation pattern similar to that of the Example 1. The bristles implanted on the brush base 3 have the polishing material 2 similar to that used in the Example 1. The brush base 3 is formed integral with a grip 5 to which a cartridge type storage portion 6 is removably connected. The storage portion 6 is loaded with a gun medicine 7 containing methyl nicotinate.

Between the brush base 3 and the grip 5 is installed a communicating passage 8 for supplying the oral-use fluid material from the storage portion 6 to the bristle-implanted surface on the brush base. The communicating passage 8 opens at one end to the bristle-implanted surface on the brush base 3 and at the other end connects to the front end of a narrow tube 13 of silicone rubber installed in the grip 5. The cartridge type storage portion 6 is removably connected to the grip 5 through a threaded joint 12. The silicone rubber tube 13 extends into the storage portion 6. The storage portion 6 has a leak valve 16 at one end to release the air in the storage portion 6. The grip 5 has a rotatable disk 14 placed on and in contact with the silicone rubber tube 13. The rotatable disk 14, as shown, has a plurality of arcuate projections 15 at equal intervals around its circumference, with the projection height being determined so that the projections 15 can intermittently press the tube 13 as the disk 14 is turned.

The toothbrush having the above construction is used in the following manner. A finger tip of the user's hand that is holding the grip 5 is put on the projections 15 on the rotatable disk 14; and the finger tip is moved to turn the disk 14 in the direction indicated by the arrow in FIG. 4. As a result the projections 15 intermittently press the silicone rubber tube 13, drawing the medicine from the storage portion 6 into the tube 13, thus supplying it further into the communicating passage 8 through which the medicine is fed to the surface of the brush base on which the bristles 1 are implanted.

EXAMPLE 3

This example is shown also in FIG. 4. A toothbrush was produced in the same way as described in Example 2, except that the polishing agent was not coated thereon and the storage means was charged with a gingiva-massaging medicine. A massaging effect was excellently obtained with use of the toothbrush.

Figure 5:
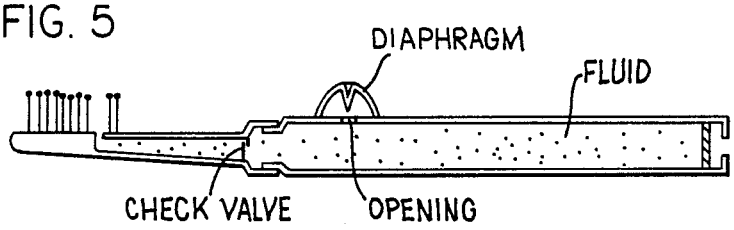
FIGS. 5 to 8 each show examples of the driving means.
Figure 6:
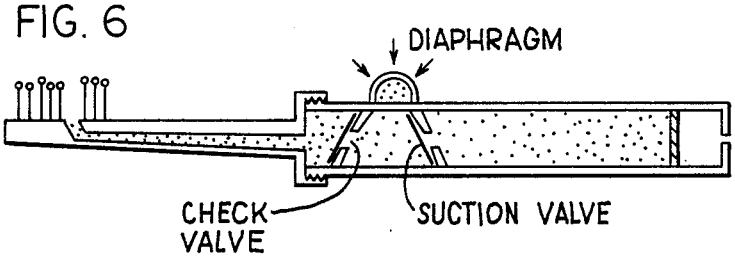
Figure 7:
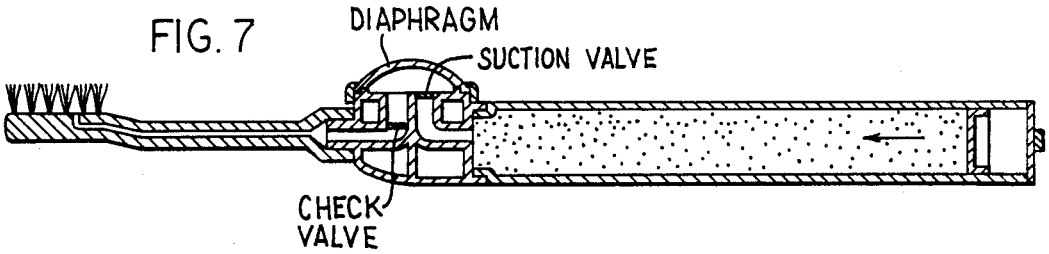
Figure 8:
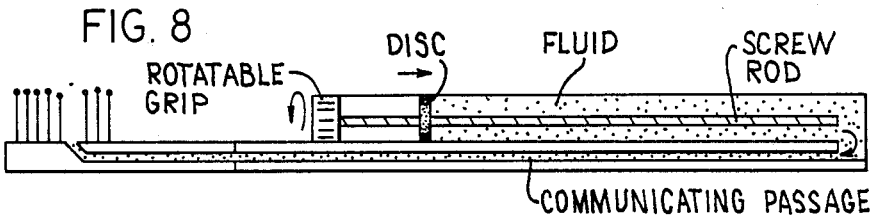

In addition to the driving device as shown in FIG. 4, the driving means for transferring the fluid material to the bristle-implanted portion includes, for example, a diaphram pump and a cylinder pump. The diaphram pump is provided on the toothbrush together with a check valve and a suction valve to effect the pumping and feeding action. These are illustrated in FIGS. 5, 6 and 7. FIG. 5 shows a combination of a diaphram and a check valve. FIGS. 6 and 7 each show a combination of a diaphram, a suction valve and a checking valve. FIG. 8 shows a disc threadedly engaged with a screw rod, which rod is rotatable by the rotatable grip whereby to move the disc.

I claim:

1. A toothbrush comprising:

a brush base portion having bristles implanted thereon and projecting therefrom, said brush base portion having a fluid outlet adjacent to said bristles, said bristles having diameters in the range of from 6/1000 to 15/1000 inch, at least 80% of said bristles having enlarged spherical tips at the free ends thereof remote from said base portion, the ratio of the diameter of said enlarged spherical tips/the diameter of the remainder of said bristles being from 1.1/1 to 2.5/1;

an elongated grip portion connected to and extending away from said base portion, said grip portion having a storage chamber therein for storing a fluid therein, said grip portion comprising a handle having an elongated, separable portion attached thereto, said separable portion defining said storage chamber;

means including a flexible tube in said handle providing a communicating passage extending from said storage chamber in said grip portion to said fluid outlet; and feeding means comprising a rotatable disc mounted on said handle and having a series of spaced-apart projections on its circumference which projections intermittently press against said tube when said rotatable disc is rotated for feeding the fluid from said storage chamber through said communicating passage to said fluid outlet.

2. A toothbrush as claimed in claim 9, which comprises a polishing material on the tips of the bristles.

3. A toothbrush as claimed in claim 2, in which said fluid is a medicinal material for oral health.

4. A toothbrush as claimed in claim 2, in which said fluid is a gingiva-massaging medicine.

5. A toothbrush as claimed in claim 1, in which said fluid is a medicinal material for oral health.

6. A toothbrush as claimed in claim 1, in which said fluid is a gingiva-massaging medicine.

* * * * *

UNITED STATES PATENT AND TRADEMARK OFFICE

CERTIFICATE OF CORRECTION

PATENT NO. : 4,963,046

DATED : October 16, 1990

INVENTOR(S) : Yasuteru EGUCHI

It is certified that error appears in the above-identified patent and that said Letters Patent is hereby corrected as shown below:

Column 6, line 43; change "9" to ---1---.

Signed and Sealed this

Seventh Day of April, 1992

*Attest:*

HARRY F. MANBECK, JR.

*Attesting Officer*

*Commissioner of Patents and Trademarks*